US008235010B2

(12) United States Patent
Chrisman et al.

(10) Patent No.: US 8,235,010 B2
(45) Date of Patent: Aug. 7, 2012

(54) AIR INTAKE PORTING FOR A TWO STROKE ENGINE

(75) Inventors: Bruce M. Chrisman, Oklahoma City, OK (US); Randy Coleman, Oklahoma City, OK (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 13/156,627

(22) Filed: Jun. 9, 2011

(65) Prior Publication Data

US 2011/0232599 A1 Sep. 29, 2011

Related U.S. Application Data

(63) Continuation of application No. 13/034,663, filed on Feb. 24, 2011, which is a continuation of application No. 12/843,774, filed on Jul. 26, 2010, now Pat. No. 7,963,258, which is a continuation of application No. 12/509,336, filed on Jul. 24, 2009, now Pat. No. 7,784,437, which is a continuation of application No. 11/779,004, filed on Jul. 17, 2007, now Pat. No. 7,578,268, which is a continuation of application No. 11/367,136, filed on Mar. 3, 2006, now Pat. No. 7,258,087.

(51) Int. Cl.
*F02B 25/00* (2006.01)

(52) U.S. Cl. ..... 123/73 AA; 123/73 FA; 123/73 PP

(58) Field of Classification Search ..... 123/73 PP, 123/73 AA, 73 FA, 73 E, 73 F, 74 AP, 74 R, 123/46 SC, 46 E, 46 H, 193.2, 193.6, 193.4, 123/65 R, 65 P, 65 E, 65 A, 65 PE, 65 VA
See application file for complete search history.

(56) References Cited

U.S. PATENT DOCUMENTS

| | | | |
|---|---|---|---|
| 2,639,699 | A | 5/1953 | Kiekhaefer |
| 2,768,616 | A | 10/1956 | Venediger |
| 3,257,998 | A | 6/1966 | Brooks |
| 3,797,467 | A | 3/1974 | Tenney |
| 3,805,750 | A | 4/1974 | Tenney |
| 3,905,340 | A | 9/1975 | Boyesen |
| 4,000,723 | A | 1/1977 | Boyesen |
| 4,066,050 | A | 1/1978 | Ford-Dunn |
| 4,135,479 | A | 1/1979 | Reitz et al. |
| 4,202,299 | A | 5/1980 | Boyesen |
| 4,352,343 | A | 10/1982 | Batoni |
| 4,383,503 | A | 5/1983 | Griffiths |
| 4,809,648 | A | 3/1989 | Luo |
| 6,279,521 | B1 | 8/2001 | Ishida et al. |
| 6,539,900 | B2 | 4/2003 | Laimbock |
| 6,662,765 | B2 | 12/2003 | Araki |
| 7,255,072 | B2 | 8/2007 | Yamaguchi |
| 7,258,087 | B1 | 8/2007 | Chrisman et al. |
| 7,363,888 | B2 | 4/2008 | Klimmek et al. |
| 7,578,268 | B2 | 8/2009 | Chrisman et al. |

(Continued)

*Primary Examiner* — Hai Huynh
(74) *Attorney, Agent, or Firm* — Fletcher Yoder, P.C.

(57) ABSTRACT

A two stroke engine of a particular configuration can have its power output increased by running bigger pistons and using ports in the piston skirt through which to conduct compressed air within the skirt through short passages in the cylinder housing that conduct the air from within the skirt to above the piston. As a result a larger piston can be used for the same spacing and opening size in the block to save the need to redesign the block and the crankshaft. A position adjuster for the piston moves it axially without rotation of the piston ports out of alignment with inlet ports in the housing. The piston rod is held in the crosshead using a flat to prevent rotation while an adjuster nut that is turned creates axial movement in the piston rod with a lock nut securing the final piston position.

25 Claims, 6 Drawing Sheets

U.S. PATENT DOCUMENTS

| | | | |
|---|---|---|---|
| 7,784,437 | B2 | 8/2010 | Chrisman et al. |
| 2003/0075124 | A1 | 4/2003 | Haman |
| 2003/0217710 | A1 | 11/2003 | Geyer et al. |
| 2004/0168656 | A1 | 9/2004 | Carlsson et al. |
| 2005/0022757 | A1 | 2/2005 | Yamaguchi et al. |
| 2006/0278183 | A1 | 12/2006 | Mavinahally et al. |
| 2010/0059030 | A1 | 3/2010 | Ishida |
| 2010/0288253 | A1 | 11/2010 | Chrisman et al. |

AIR INTAKE PORTING FOR A TWO STROKE ENGINE

CROSS REFERENCE TO RELATED APPLICATIONS

This application is a continuation of U.S. patent application Ser. No. 13/034,663, filed on Feb. 24, 2011, which is hereby incorporated by reference in its entirety, which is a continuation of U.S. patent application Ser. No. 12/843,774, filed on Jul. 26, 2010, which is hereby incorporated by reference in its entirety, which is a continuation of U.S. patent application Ser. No. 12/509,336, filed on Jul. 24, 2009, and issued as U.S. Pat. No. 7,784,437, on Aug. 31, 2010, which is hereby incorporated by reference in its entirety, which is a continuation of U.S. patent application Ser. No. 11/779,004, filed on Jul. 17, 2007, and issued as U.S. Pat. No. 7,578,268, on Aug. 25, 2009, which is hereby incorporated by reference in its entirety, which is a continuation of U.S. patent application Ser. No. 11/367,136, filed on Mar. 3, 2006, and issued as U.S. Pat. No. 7,258,087, on Aug. 21, 2007, which is hereby incorporated by reference in its entirety.

BACKGROUND

The field of this invention is two stroke engines and, more particularly, relates to an air intake porting configuration that allows an increased cylinder bore and facilitates a corresponding power increase for a given exterior cylinder dimension.

In an effort to get more power out of a given frame size for a two stroke engine, one readily apparent way is to simply increase the bore of the cylinders. As a result, the power output increases by the square of the ratio of the new bore divided by the previous bore. The problem with doing this is that the throws on the crankshaft have given spacing, and the enlargement of the bore forces an increase in external dimensions of the cylinder. The existing block may also define limits to any desired increase of the bore, depending on the available spacing between the existing bores, for instance. The problem with expanding the bore size of two stroke engines is that air intake passages to the cylinder require a fair amount of space, because of their location. In the past, air was introduced through passages extending from the crank end of the power cylinder to the intersection of the intake ports with the main bore of the cylinder. Another way was to build an air chest into the engine block around the intake ports for the cylinder. However this method would substantially increase the size of the engine block, which increases the weight of the engine and may not be compatible with the given engine bay, for instance.

While a wholly new engine could be designed, such a process can be expensive and time consuming. It is clearly desirable if the bore size can be increased without major changes to the basic engine structure. In accordance with certain embodiments, the present invention provides methods and apparatus to increase the bore sizes of a given engine design without significant changes to the frame or crankshaft. The invention is put into perspective by a quick review of two stroke engine basics, shown in FIG. 1, and a comparison of the intake porting of a known design with that of the present invention shown in a comparison of FIGS. 2 and 3.

Referring to FIG. 1, a piston 10 having a rod 12 is disposed in a cylinder housing 14. The piston 10 also has a skirt 16 that defines a volume 18 around the rod 12. An inlet valve housing 20 includes a reed valve 22 that operates like a check valve. In the view of FIG. 1, the piston 10 is descending after a power stroke. Air that previously was drawn into housing 20 and past reed valve 22 is forced out of volume 18 as shown by arrows 24. That air that had been compressed under the skirt during the decision from the power stroke can, after the piston descends enough to expose the inlet ports 26, exit from under the skirt 16 to a passage 28 in the cylinder housing 14. The release of the pressurized air through passage 28 and through ports 26 scavenges out the remaining exhaust gasses in the cylinder 30 to exit through the exposed exhaust ports 32. After this happens, the piston 10 rises to close off intake ports 26 and exhaust ports 32. At that point, gas is injected through the gas injection valve 34, and the spark plug 36 ignites the mixture when the piston has nearly reached top dead center. Again the upward movement of the piston while the ports 26 and 32 are closed by the piston opens the reed valve 22 to allow more air to get sucked in. The cycles just described simply repeat as the engine operates.

FIG. 2 is similar to FIG. 1 and is placed on the same sheet as FIG. 3 to allow for an easy comparison of the differences therebetween. Referring first to FIG. 2, it can be seen that the presence of passage 28 leading to ports 26 along the outside of skirt 16 directly defines the size of the surrounding cylinder housing 14. In a given engine, any increase in the bore size $B_1$ necessarily increases the size of the cylinder housing 14 and necessitates a redesign of the crank and engine frame, for example. These and other aspects of the present invention will be more apparent to those skilled in the art from a review of the description of the preferred embodiment and the associated drawings and the claims which define the full scope of the invention.

SUMMARY OF THE INVENTION

As will be described below, the present invention, in accordance with certain embodiments, reconfigures the intake air routing to make use of the space formerly occupied by passage 28 to accommodate a bigger piston so that the cylinder housing 14 will fit on the same connection to the block 38. This is made possible by routing the air inlet through the piston skirt, as will be explained below. As will also be explained below, the position adjustment mechanism for the piston will also be explained. This mechanism adjusts the piston position axially without need to rotate the piston.

In accordance with certain embodiments, a two stroke engine of a particular configuration can have its power output increased via a larger cylinder bore and by using ports in the piston skirt through which to conduct compressed air within the skirt through short passages in the cylinder housing that conduct the air from within the skirt to above the piston. As a result, a larger piston can be used for the same spacing and opening size in the block, reducing the need to redesign the block and the crankshaft, for instance. A position adjuster for the piston moves it axially without rotation of the piston ports out of alignment with inlet ports in the housing. The piston rod is held in the crosshead using a flat to prevent rotation while an adjuster nut that is turned creates axial movement in the piston rod with a lock nut securing the final piston position.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
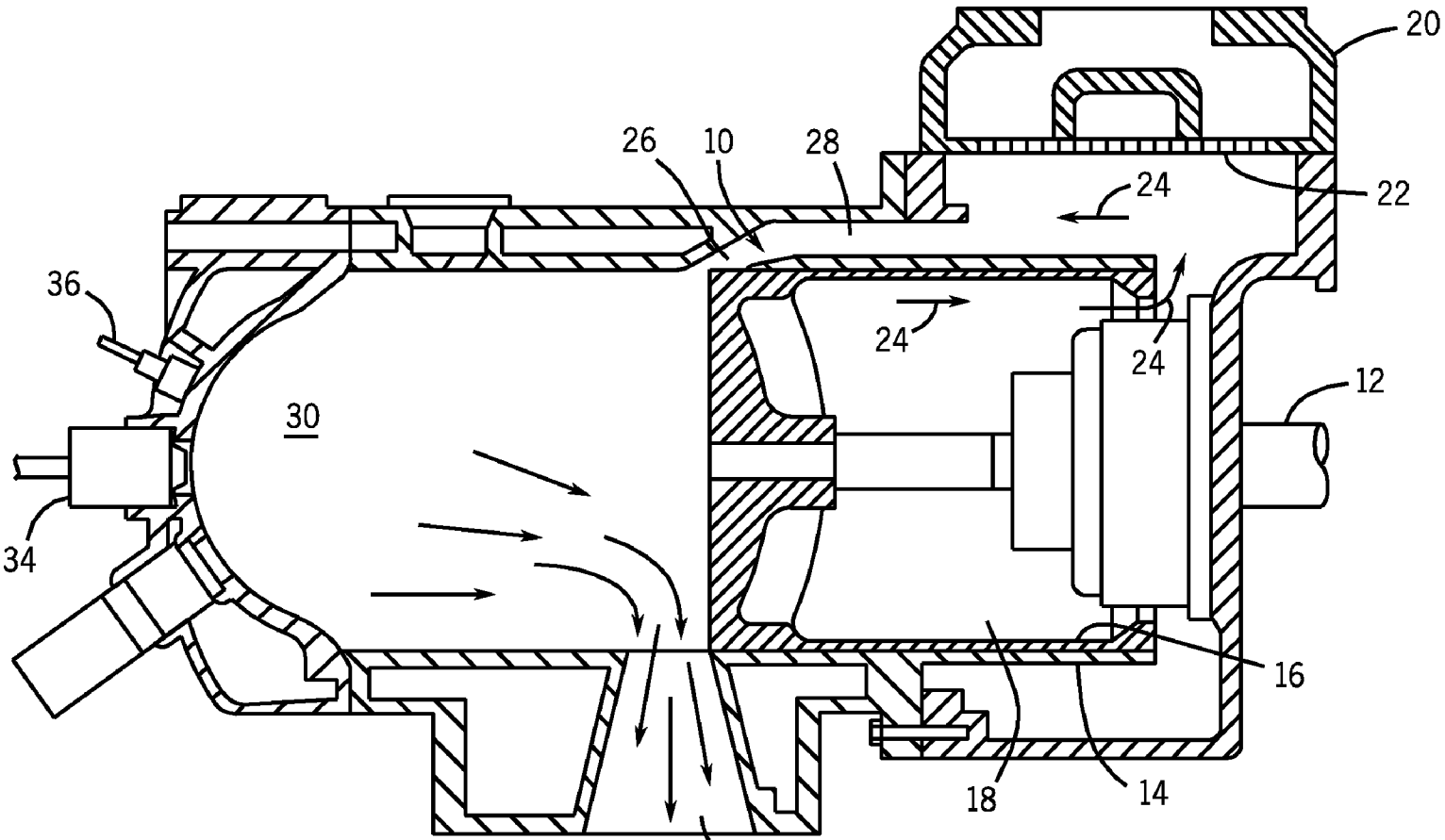
FIG. 1 (PRIOR ART)
FIG. 1 is a section view of a known design for a two stroke engine showing a single cylinder.
Figure 2:
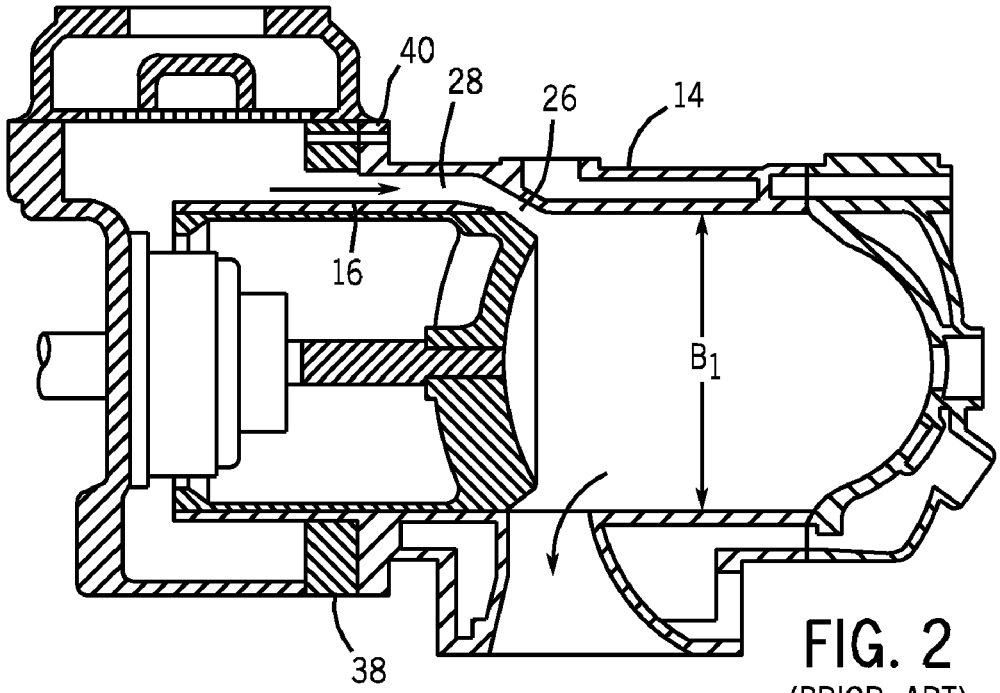
FIG. 2 (PRIOR ART)
FIG. 2 is another section view of the cylinder of FIG. 1.
Figure 3:
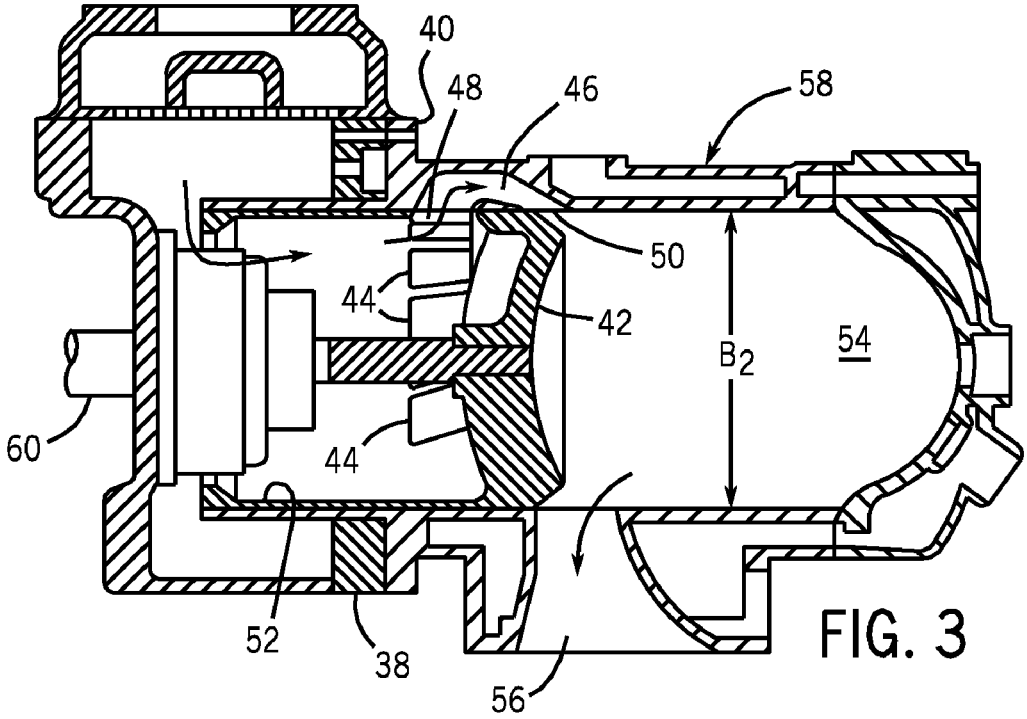
FIG. 3 is a section view of the ported piston design of the in accordance with an embodiment of the present invention.
Figure 4:
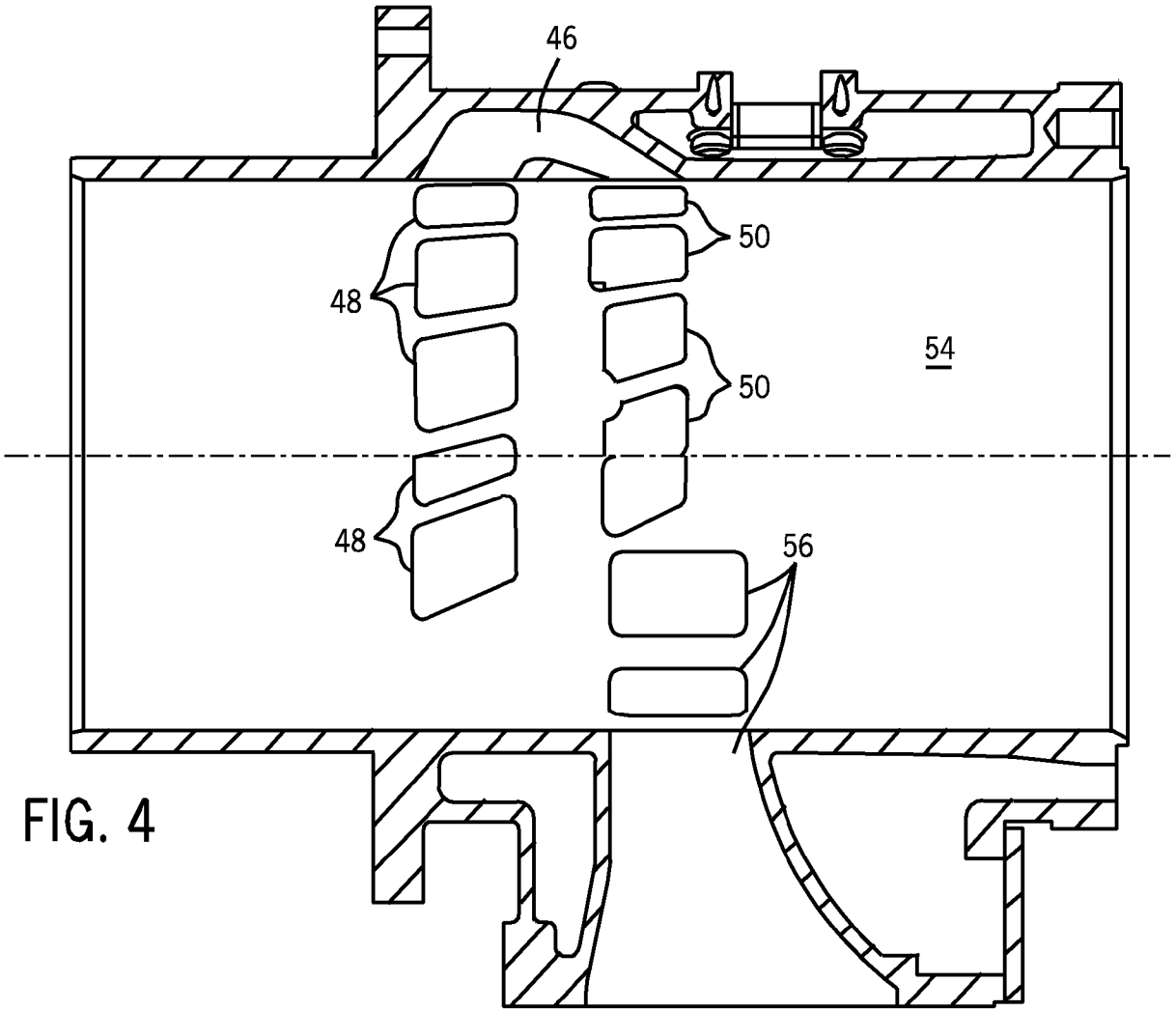
FIG. 4 is a perspective view of a cylinder bore showing the inlet air passages with the lower row being the one that eventually aligns with the ports in the piston skirt.
Figure 5:
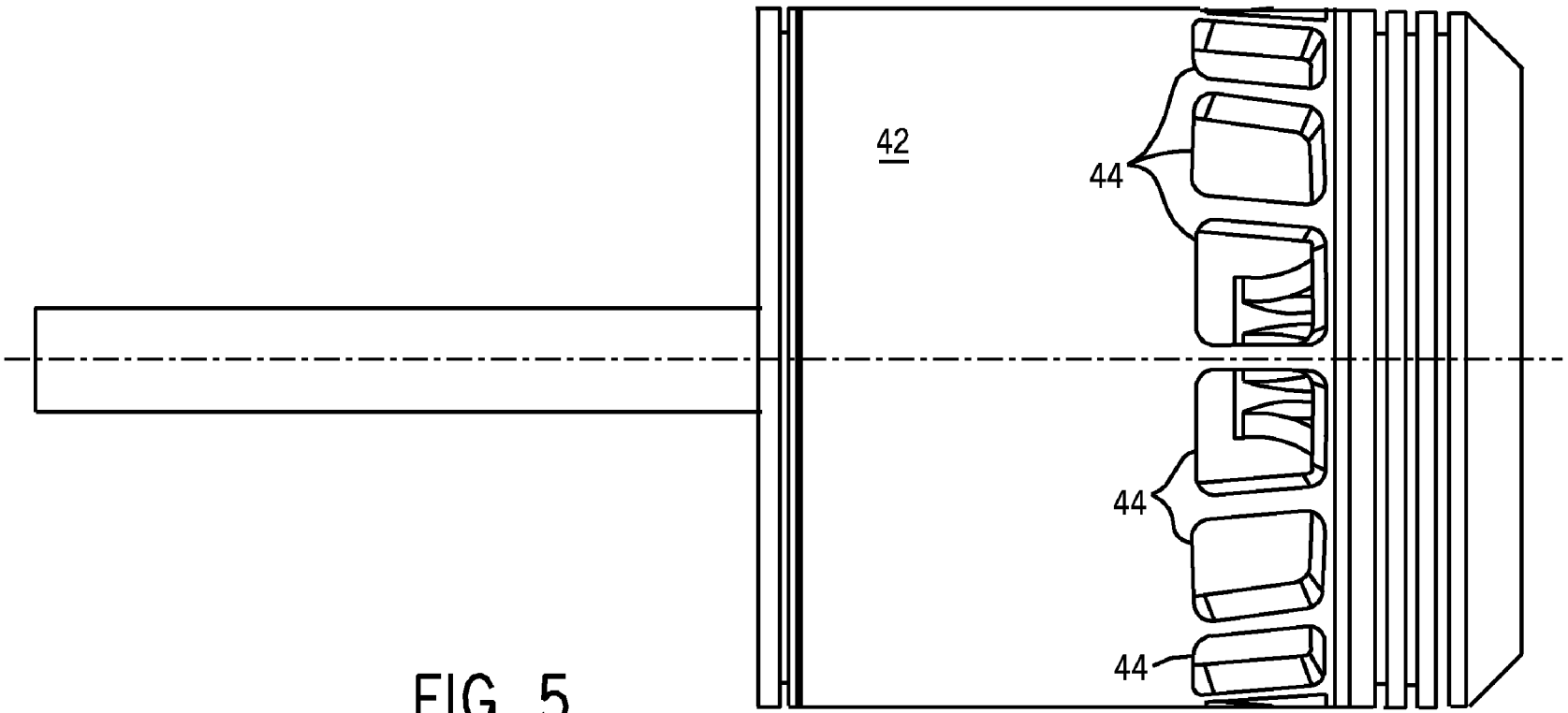
FIG. 5 is a perspective view of the piston showing the ports in the skirt.
Figure 7:
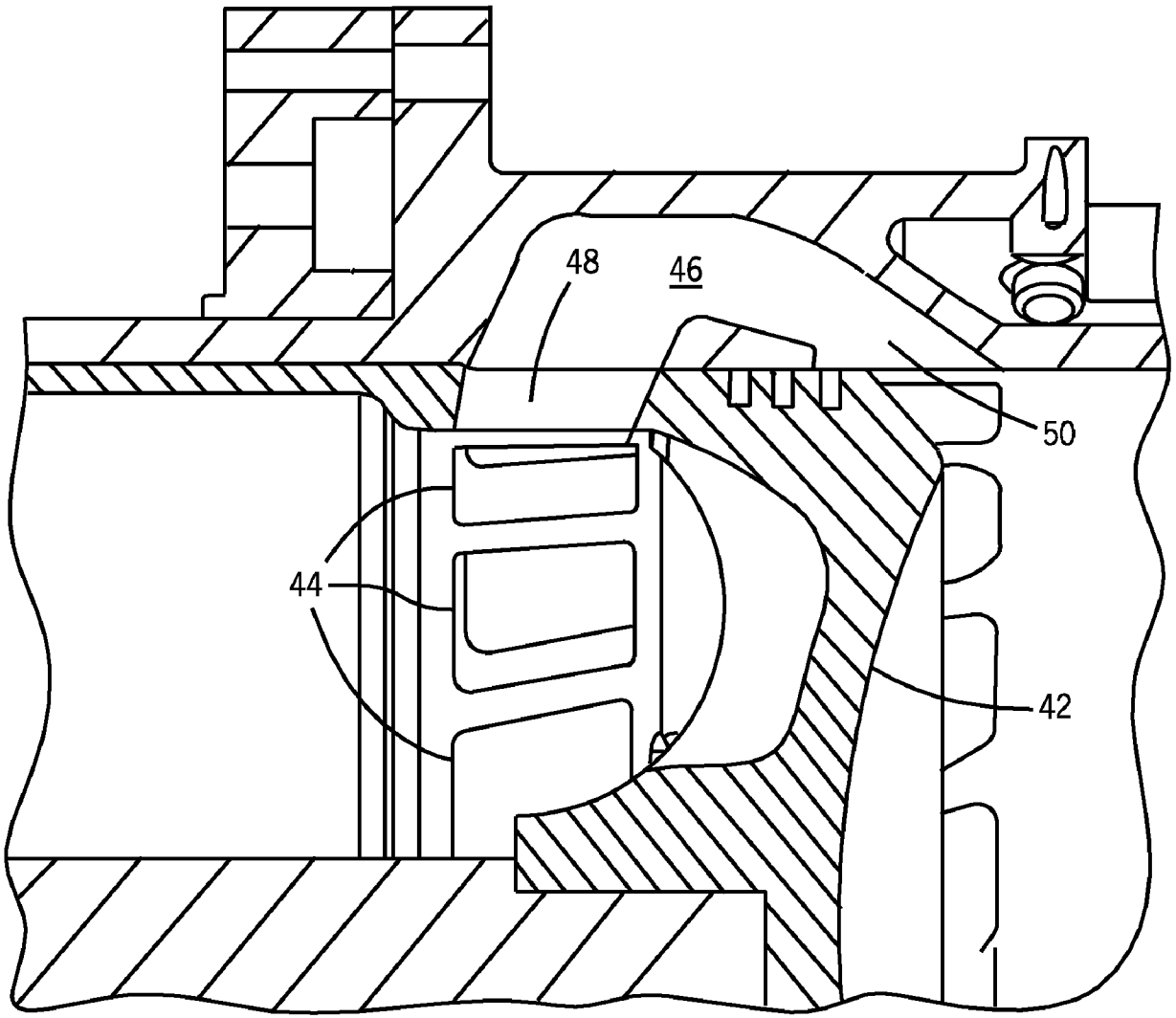
FIG. 7 is a detailed view of the piston ports aligned with the inlet passages in the cylinder assembly.

Referring to exemplary embodiment of the present invention illustrated in FIG. 3, the cylinder diameter $B_2$ is larger than the diameter $B_1$ yet the cylinder base 40 mounts to the same block connection 38 shown in both FIGS. 2 and 3. The reason a bigger piston 42 can be used is that the passage 28 from the FIG. 2 design has been eliminated in favor of a series of ports 44 arranged circumferentially at preferably a common axial elevation on the piston 42. The space formerly taken up by the passage 28 leading to outlets 32 in the prior design of FIG. 2 has been used to house a larger diameter piston 42. The cylinder housing 58 has reconfigured porting. It now features a generally C-shaped passage 46 having inlet ports 48 and outlet ports 50. When the ports 44 in the piston 42 come into alignment with inlets 48 of passage 46, the air that has already been pressurized within the skirt 52 on the down stroke of the piston 42 in what can be referred to as the lower zone can now escape into the cylinder volume 54 that can also be referred to as the compression zone. As this intake air enters this compression zone, it displaces (scavenges) the remaining exhaust gases from volume 54 out the exhaust ports 56. FIG. 4 shows some of the inlets 48 and their associated outlets 50 that are axially above in the cylinder 54. The outlets 50 have their shape optimized to best displace the residual exhaust gasses from the cylinder 54. As illustrated, the ports 48 and 50 are circumferentially offset from the exhaust ports 56. FIG. 5 gives a better view of the exemplary piston 42 with ports 44 at a common axial height and disposed circumferentially in a pattern that occupies, as presently illustrated, at least half the circumference. In the exemplary embodiment, the dimensions of ports 44 match the dimensions of inlets 48 on the passage 46 in the cylinder housing 58. Alignment of these ports is shown in FIG. 7. These pairs of openings should be maintained in a circumferential alignment to maximize the compressed air flow and the transfer of energy in the cylinder 54 after movement of piston 42 brings ports 44 up into alignment with inlets 48 in the housing 58.

Figure 6:
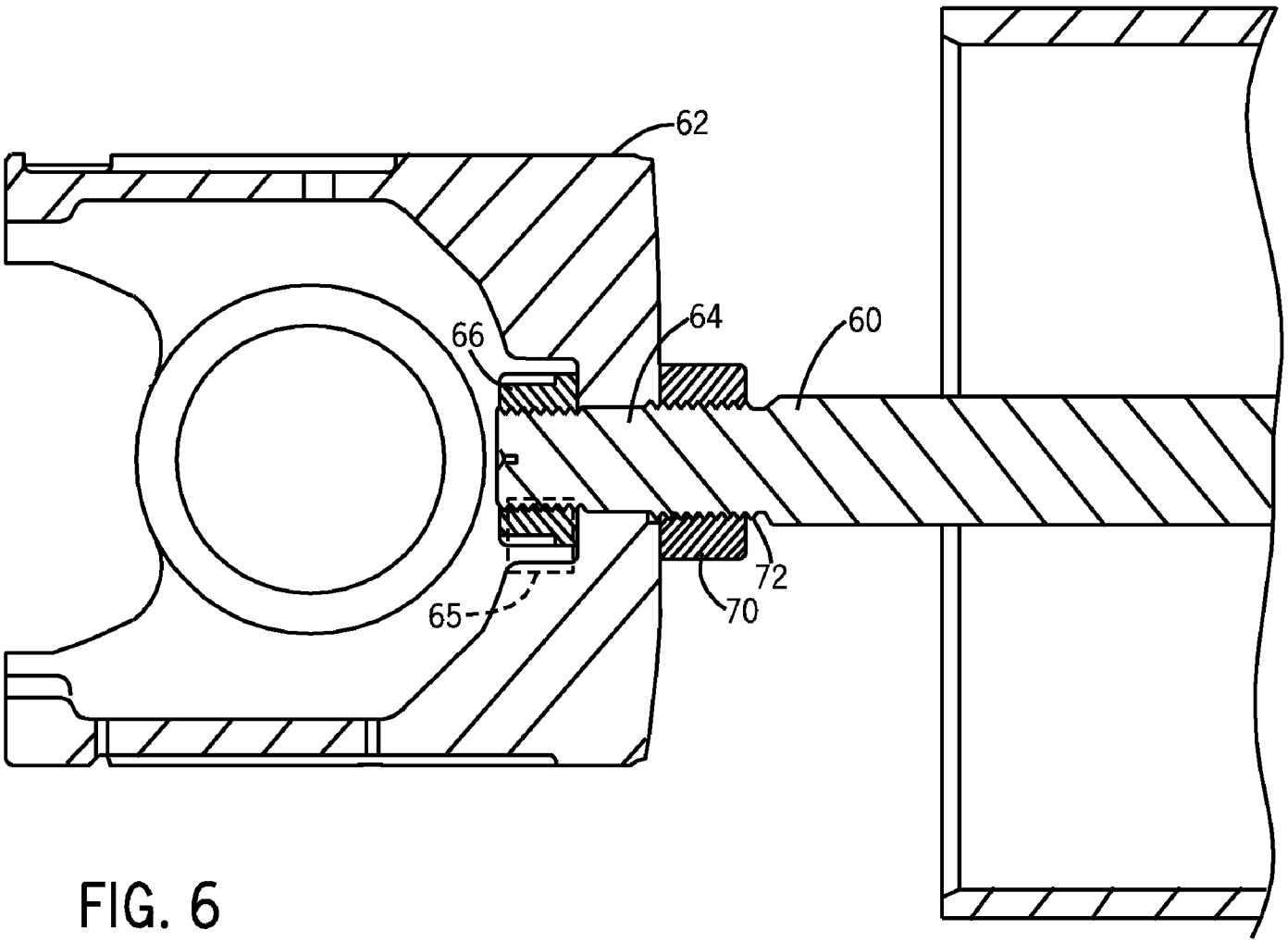
FIG. 6 illustrates the connection of the piston rod to the crosshead and shows the axial adjustment mechanism for the piston.

It is beneficial if the piston position adjustment is able to move the piston 42 axially without rotating it, so as not to misalign circumferentially openings 44 in the skirt 52 with inlets 48 on cylinder housing 58. As shown in FIGS. 3 and 6, the piston rod extends partially through the crosshead 62 that is connected to the crankshaft (not shown) in a known manner. The extension of the rod 60 though the crosshead 62 is though an opening with a flat to match the flat 64 on rod 62. Rod 60 is allowed to move axially but not rotate when the adjusting nut 66 is turned through access hole 65. A lock nut 70 sits on threads 72 on rod 60. The minimum distance between the piston crown and the cylinder head, as illustrated, is adjustable to set the proper compression ratio for the engine. When the desired adjustment for the final position of piston 42 at top dead center is reached to get the desired clearance, the lock nut 70 is turned on threads 72 against the crosshead 62. Turning the adjuster nut 66 forces the rod 60 to move axially since flat 64 on rod 60 constrains rotation.

Those skilled in the art will appreciate that the elimination of the air intake passage outside the piston skirt has allowed the piston to take up that space to increase its size for a given opening in the block. For that reason the block and crank don't need to be redesigned and a given engine frame and crank can accommodate a bigger piston to increase the power output. The larger piston now directs the compressed air from within its skirt though skirt openings. As the piston rises the skirt openings come up to align with the openings 48 in passages 46 in the cylinder housing 58. The compressed air passes from below piston 42 to above it. The difference in the designs is that the porting of the air through the skirt 52 allows the piston 42 to occupy space formerly used for air passages 28. As a result, the larger piston 42 can be accommodated in the same mount on an existing block. Additional power output is possible from a known engine block and crankshaft combination. Thus assuming the remaining components can deal with the additional power produced the need for a total redesign to get more power is avoided. What results is the ability to increase piston size to the size of the opening in the block by eliminating air passages outside the skirt and taking advantage of the volume within the skirt to hold the compressed air and deliver it at the proper time when ports are in alignment.

The adjuster mechanism allows axial adjustment of the piston 42 without rotating it so that ports 44 stay in circumferential alignment with inlets 48 while the needed clearance is obtained to set the proper compression ratio with the piston at top dead center.

The above description is illustrative of the preferred embodiment and many modifications may be made by those skilled in the art without departing from the invention whose scope is to be determined from the literal and equivalent scope of the claims below.

Again, the above description is illustrative of exemplary embodiments, and many modifications may be made by those skilled in the art without departing from the invention whose scope is to be determined from the literal and equivalent scope of the claims below.

The invention claimed is:

1. A system, comprising a piston, comprising:

a head;

a skirt extending from the head; and a first port through the skirt, wherein the first port comprises a first polygonal shape having a plurality of sides angled relative to one another along an exterior surface of the skirt, the plurality of sides comprise a first side extending in a first direction along the exterior surface of the skirt, and the first direction of the first side is acutely angled relative to an axis of the piston.

2. The system of claim 1, wherein the first polygonal shape comprises a first trapezoidal shape defined by the plurality of sides.

3. The system of claim 2, wherein the first trapezoidal shape has the first side, a second side opposite from the first side, and third and fourth sides opposite from one another, wherein the first and second sides extend in respective first and second directions along the exterior surface of the skirt, and the first and second directions are acutely angled relative to the axis of the piston, the third and fourth sides extend in respective third and fourth directions along the exterior surface of the skirt, and the third and fourth directions are perpendicular relative to the axis of the piston.

4. The system of claim 1, wherein the first polygonal shape has a second side extending in a second direction along the exterior surface of the skirt, and the second direction is acutely angled relative to the axis of the piston.

5. The system of claim 4, wherein the first polygonal shape has a third side extending in a third direction along the exterior surface of the skirt, and the third direction is perpendicular to the axis of the piston.

6. The system of claim 1, wherein the piston comprises a second port through the skirt, and the second port comprises a second polygonal shape having at least one side extending in a second direction along the exterior surface of the skirt, and the second direction is acutely angled relative to the axis of the piston.

7. The system of claim 6, wherein the first and second ports are disposed diametrically opposite from one another relative to the axis of the piston.

8. The system of claim 6, wherein the first and second ports are disposed at a common axial position relative to the axis of the piston.

9. The system of claim 1, comprising an anti-rotation feature configured to prevent rotation of the piston about an axis of the piston.

10. The system of claim 1, wherein the first port is configured to route intake fluid through the skirt and into a passage through a portion of a cylinder around the head of the piston.

11. The system of claim 10, comprising a machine having the piston disposed in the cylinder.

12. A system, comprising:

a cylinder having a wall surrounding a piston path along an axis of the cylinder, wherein the wall comprises a first port having a first polygonal shape with a plurality of sides angled relative to one another along an interior surface of the wall, the plurality of sides comprise a first side extending in a first direction along the interior surface of the wall, and the first direction of the first side is acutely angled relative to the axis of the cylinder; and a fluid passage through a portion of the wall along the piston path, wherein the fluid passage is configured to route fluid around a head of a piston between opposite chambers separated by the piston.

13. The system of claim 12, wherein the first polygonal shape comprises a first trapezoidal shape defined by the plurality of sides.

14. The system of claim 12, wherein the first polygonal shape has a second side extending in a second direction along the interior surface of the wall, and the second direction is acutely angled relative to the axis of the cylinder.

15. The system of claim 14, wherein the first polygonal shape has a third side extending in a third direction along the interior surface of the wall, and the third direction is perpendicular to the axis of the cylinder.

16. The system of claim 12, wherein the wall comprises a second port having a second polygonal shape with at least one side extending in a second direction along the interior surface of the wall, and the second direction is acutely angled relative to the axis of the cylinder, the first and second ports are axially offset from one another, and the fluid passage connects the first and second ports.

17. The system of claim 16, wherein the second polygonal shape comprises a second trapezoidal shape.

18. The system of claim 12, comprising an air intake configured to route air into the cylinder, wherein the air intake is separate from the piston path.

19. The system of claim 12, comprising the piston disposed in the cylinder.

20. The system of claim 19, wherein the piston comprises a second port having a second polygonal shape with a second plurality of sides angled relative to one another along an exterior surface of a skirt of the piston, the second plurality of sides comprise at least one side extending in a second direction along the exterior surface of the skirt, and the second direction is angled relative to the axis of the cylinder.

21. The system of claim 19, comprising an engine having the cylinder and the piston.

22. A system, comprising:

a cylinder, comprising:

a wall having an interior surface; and a passage through the wall from a first port to a second port along the interior surface, wherein the first and second ports are axially offset from one another relative to an axis of the cylinder; and a piston disposed in the cylinder, wherein the piston comprises:

a head;

a skirt extending from the head; and a third port through the skirt, wherein the third port is configured to align with the first port to enable a fluid flow through the passage around the head of the piston between opposite chambers separated by the piston, and at least one port of the first, second, or third ports comprises a polygonal shape with first and second sides acutely angled relative to one another along an exterior surface of the skirt.

23. The system of claim 22, wherein the polygonal shape comprises a trapezoidal shape.

24. The system of claim 22, wherein the polygonal shape has a third side obtusely angled relative to the first side.

25. The system of claim 24, wherein the polygonal shape has a fourth side obtusely angled relative to the second side and/or acutely angled relative to the third side.

* * * * *